US006457935B1

(12) United States Patent
Antunes et al.

(10) Patent No.: US 6,457,935 B1
(45) Date of Patent: Oct. 1, 2002

(54) SYSTEM FOR VENTILATING A PAIR OF JUXTAPOSED VANE PLATFORMS

(75) Inventors: Serge Louis Antunes, Combs la Ville; Eric Stephan Bil, Chartrettes; Isabelle Monique Marie Bourriaud; Maurice Guy Judet, both of Dammarie les Lys, all of (FR)

(73) Assignee: SNECMA Moteurs, Paris (FR)

( * ) Notice: Subject to any disclaimer, the term of this patent is extended or adjusted under 35 U.S.C. 154(b) by 0 days.

(21) Appl. No.: 09/883,948

(22) Filed: Jun. 20, 2001

(51) Int. Cl.[7] ..... F01D 5/18; F03B 3/12
(52) U.S. Cl. ..... 415/115; 416/193 A
(58) Field of Search ..... 416/97 R, 193 A; 415/115

(56) References Cited

U.S. PATENT DOCUMENTS

| | | | | |
|---|---|---|---|---|
| 2,656,147 A | * | 10/1953 | Brownhill et al. | 416/193 A |
| 4,767,260 A | | 8/1988 | Clevenger et al. | |
| 5,281,097 A | | 1/1994 | Wilson et al. | 416/193 A |
| 5,513,955 A | | 5/1996 | Barcza | 416/193 A X |
| 5,573,375 A | * | 11/1996 | Barcza | 416/193 A X |
| 5,599,170 A | * | 2/1997 | Marchi et al. | 416/193 A X |
| 6,017,189 A | | 1/2000 | Judet et al. | 416/193 A X |

FOREIGN PATENT DOCUMENTS

| | | | | |
|---|---|---|---|---|
| DE | 37 30 411 | | 4/1988 | |
| EP | 0 375 984 | | 3/1990 | |
| FR | 2 758 855 | | 7/1998 | |
| GB | 1259750 | * | 1/1972 | 416/193 A |
| GB | 2 280 935 | | 2/1995 | |

OTHER PUBLICATIONS

Patent Abstracts of Japan, vol. 009, No. 142, Jun. 18, 1985, and JP 60–22002, Feb. 4, 1985.

* cited by examiner

*Primary Examiner*—John E. Ryznic
(74) *Attorney, Agent, or Firm*—Oblon, Spivak, McClelland, Maier & Neustadt, P.C.

(57) ABSTRACT

A sheet metal sealing sleeve placed under a pair of juxtaposed blade platforms in a turbomachine so as to cover the gap between them is provided with apertures to allow the flow of a ventilating gas to the platforms. The apertures are provided in bosses formed on the sleeve to define chambers between the sleeve and the platforms which provide for greater heat exchange by virtue of the forcible impact of the gas blown through the apertures under the platforms. The sleeve also aids in damping platform vibration.

3 Claims, 2 Drawing Sheets

SYSTEM FOR VENTILATING A PAIR OF JUXTAPOSED VANE PLATFORMS

BACKGROUND OF THE INVENTION

1. Technical Field

The invention relates to a system for ventilating a pair of juxtaposed blade platforms in a turbomachine.

Ventilating systems found in turbomachines generally involve blowing a stream of gas onto a portion of a structure which is at a temperature different than the gas in order to protect the structure from excessive heating or, in certain applications, in order to regulate its thermal expansion so as to control a clearance and thereby improve the throughput of the machine.

The invention concerns the ventilation of blade platforms installed side by side in the same circumferential array of blades so as to cover the cavities separating the lower portions of the blades and to give the flow path of the machine a more uniform contour. The cavities can be put to use by blowing the ventilating gas into them. However, the ventilating gas would leave the cavities via gaps between the platforms and would therefore have little effect.

2. Summary of the Prior Art

It is known to place sealing means under the platforms to block these gaps between the platforms. The sealing pieces are designed to allow the ventilating gas to reach the portions of the platforms that it is desired to ventilate, and these portions are equipped with vent orifices that the gas passes through in order to leave the cavities. The desired heat exchange is achieved principally by virtue of the gas passing through these vent orifices.

One such system is described in French Patent 2758855, wherein the sealing pieces are metal sleeves, formed of sheet metal, which rest under the underside of the platforms, centrifugal forces produced as the blades rotate urging the sleeves against the platforms. The sheet metal sleeves have apertures through which the ventilating gas passes in order to reach the platforms, these apertures opening into collecting channels cat in the platforms. These channels are at the ends of serpentine coils, that is to say sinuous ducts, through which the ventilating gases must travel in order to reach the vent orifices passing through the platforms. Heat exchange is by convection. However, it has been concluded that this arrangement is not effective enough.

SUMMARY OF THE INVENTION

The object of the invention is therefore to improve the sheet metal sealing sleeves so as to increase the heat exchange attributable to the ventilating gas without compromising sealing, while at the same time obtaining satisfactory damping or the blade platform vibration.

Accordingly, the invention provides a system for ventilating a pair of juxtaposed blade platforms covering a cavity in a turbomachine, comprising vent orifices passing through the platforms, a sealing sleeve having apertures passing through it arranged under the platforms in the cavity, and means for blowing ventilating gas into the cavity, wherein said sleeve is provided with bosses at the sites of said apertures whereby chambers are defined between said platforms and said bosses, said vent orifices opening into said chambers.

This means that the ventilating gas passing through the apertures in the sleeve is blown toward the platforms at a speed which increases heat exchange by virtue of the impact of the gas against the platforms.

Advantageously, the bosses extend parallel to a junction between the platforms so that each encompasses a number of apertures or a number of vent orifices. It is also advantageous for each of the vent orifices to face a respective one of the apertures, so as to make it easier for the ventilating gases to flow.

DESCRIPTION OF THE PREFERRED EMBODIMENT

Figure 1:
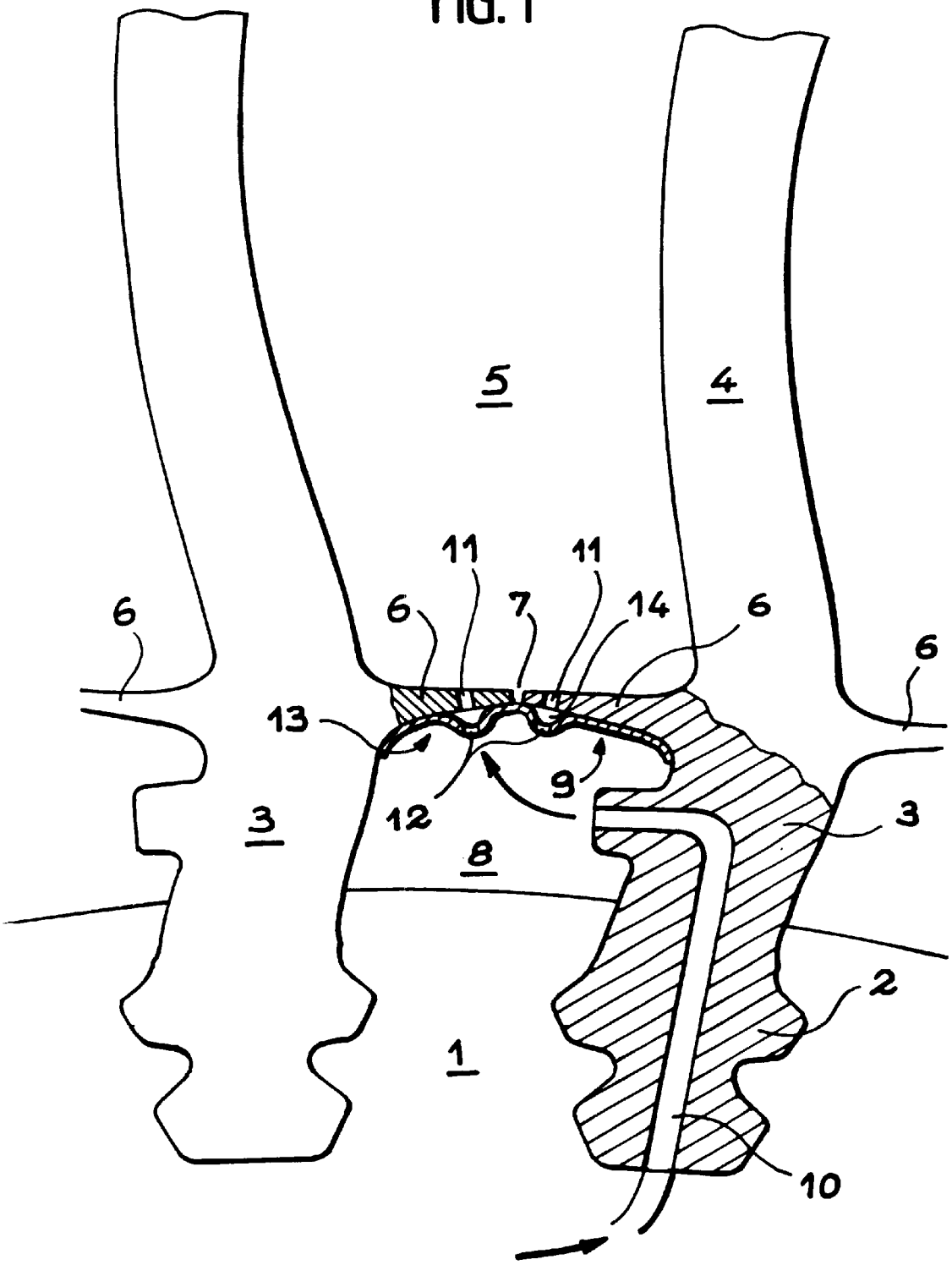
FIG. 1 is a front-on view of a pair of blades provided with one embodiment of a ventilating system in accordance with the invention.

The invention is particularly applicable to the moving blades of a turbine, and especially to the blades of the first stage of a high-pressure turbine, which are subjected to very great heating from the nearby combustion chamber, and which are inserted in grooves of a disk 1. The blades comprise a root 2 engaged in a groove of the disk 1, a post 3, and a vane 4 which constitutes the working part of the blade located in the combustion gas flow path 5. In addition, they comprise a platform 6 approximately in the shape of an arc of a circle and extending around the junction between the post 3 and the vane 4. The platforms 6 of a pair of adjacent blades are juxtaposed, leaving a gap 7 between them, which gap connects the flow path 5 with a cavity 8 bounded by the platforms 6 and the posts 3 of the adjacent blades and by the disk 1. This gap 7 is closed by a sealing piece which consists of a sheet metal sleeve 9 disposed in the cavity 8 and covering the underside of the platforms 6 and the gap 7 between one post 3 and the next.

Figure 2:
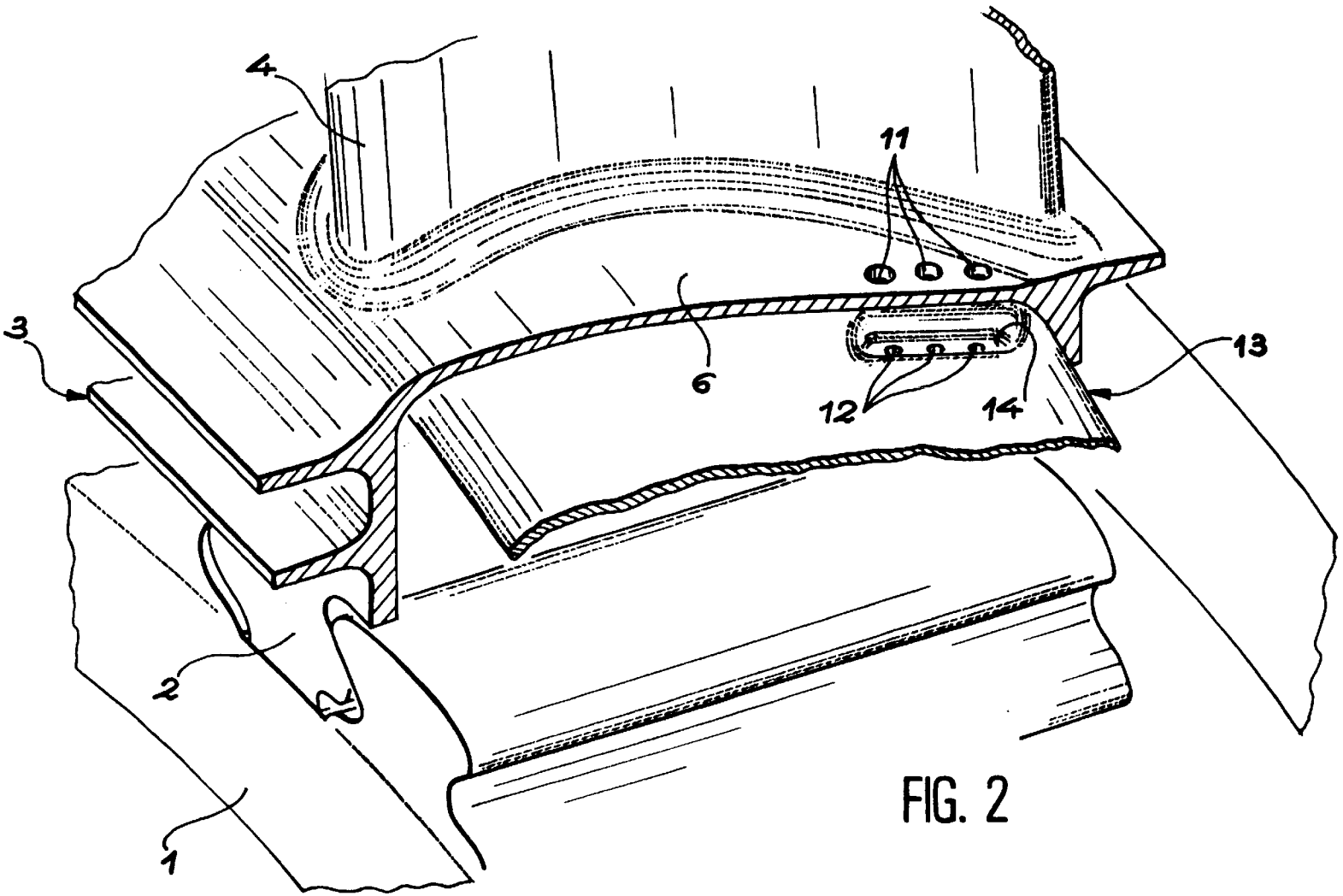
FIG. 2 is a perspective cut-away view of a junction between blades, showing a sealing sleeve of the ventilation system in position beneath a blade platform.

Cool ventilating gas is blown into the cavity 8 via a duct 10 cut through the root 2 and the post 3 of one of the nearby blades or through an inter-blade hole upstream of the cavity 8. The gas ordinarily comes from the compressor or from the turbine of the machine. However, as there are many possible known ways of constructing the circuit for supplying the ventilating gap which have been abundantly described elsewhere, they need not be described here. Vent orifices 11 pass through the platforms 6 at the sites at which cooling is required, the vent orifices 11 allowing the gas to leave the cavity 8 and join the flow path 5. The sleeve 9 has apertures 12 situated respectively facing the vent orifices 11, and bosses 13 are formed on the sleeve 9 at the sites of these apertures 12 so as to form chambers 14 between the bosses 13 and the platforms 6. It can be seen in FIG. 2 that the bosses 13 extend longitudinally parallel to the gap 7 so as to encompass several vent orifices 11 and apertures 12.

The purpose of the bosses is that the ventilating gas passing through the apertures 12 and being blown toward the platforms 6 cools them by impact, to a greater extent than in the design of the prior art where cooling is achieved by convection.

Apart from the bosses 13, the sleeve 9 more or less follows the underside surface of the platforms 6, except perhaps at the ends, which may be curved. It is flexible enough to seat well under the platforms 6, with a certain pressure, when the centrifugal forces originating from the rotation of the disk 1 are applied to it, and therefore aids in damping their vibration.

We claim:

1. A system for ventilating a pair of juxtaposed blade platforms covering a cavity in a turbomachine, comprising vent orifices passing through the platforms, a sealing sleeve having apertures passing through it arranged under the platforms in the cavity, and means for blowing ventilating gas into the cavity, wherein said sleeve is provided with bosses at the sites of said apertures whereby chambers are defined between said platforms and said bosses, said vent orifices opening into said chambers.

2. The system as claimed in claim 1, wherein said bosses extend parallel to a junction between said platforms.

3. The system as claimed in either of claims 1 and 2, wherein said vent orifices each face a respective one of said apertures.

* * * * *